United States Patent [19]

Boenninghaus

[11] 4,168,053

[45] Sep. 18, 1979

[54] EXTRACTION DEVICE FOR DITCH SHEETING ELEMENTS

[75] Inventor: Rolf Boenninghaus, Hamm, Fed. Rep. of Germany

[73] Assignees: Magdalene Boenninghaus, Hamm; Josef Krings, Heinsberg, both of Fed. Rep. of Germany

[21] Appl. No.: 835,019

[22] Filed: Sep. 20, 1977

[30] Foreign Application Priority Data

Sep. 23, 1976 [DE] Fed. Rep. of Germany ..... 2642766

[51] Int. Cl.[2] ..... B66D 3/08

[52] U.S. Cl. ..... 254/189; 254/139.1

[58] Field of Search ..... 254/139, 139.1, 167, 254/168, 188, 189, 197

[56] References Cited

U.S. PATENT DOCUMENTS

| | | | |
|---|---|---|---|
| 1,719,021 | 7/1929 | Petersen | 254/139 |
| 2,630,334 | 3/1953 | Ewers | 254/139.1 X |
| 3,311,351 | 3/1967 | Blakely | 254/189 X |
| 3,589,680 | 6/1971 | Kuhn | 254/189 |
| 3,874,517 | 4/1975 | Rajen et al. | 254/189 X |
| 4,022,433 | 10/1977 | Kondo | 254/188 |

FOREIGN PATENT DOCUMENTS

| | | | |
|---|---|---|---|
| 1176423 | 6/1957 | France | 254/188 |
| 1219229 | 1/1971 | United Kingdom | 254/139.1 |

*Primary Examiner*—Trygve M. Blix
*Assistant Examiner*—Winston H. Douglas
*Attorney, Agent, or Firm*—Diller, Ramik & Wight

[57] ABSTRACT

An extraction mechanism which may be utilized for the purpose of pulling sheeting elements after they have been utilized in shoring ditches. The apparatus includes a tower which may be seated firmly on the ground and have the top end thereof positioned by means of a boom of equipment utilized in the normal trenching operation. A series of cables and pulleys are provided with there being a hydraulic cylinder for effecting the relative movement of certain of the pulleys so as to foreshorten the cable or cables and thus produce the necessary pulling effort. The system includes winding reels to take up the pulled cable slack and clamp means for preventing movement of the cable first in one direction and then the other direction in accordance with the direction of movement of the fluid cylinder.

15 Claims, 3 Drawing Figures

EXTRACTION DEVICE FOR DITCH SHEETING ELEMENTS

This invention relates to equipment for the extraction of sheeting walls, sheeting plates, floor sheeting and like sheeting elements used in trenching operations and particularly relates to apparatus including a tower-like housing approximately of the heighth of the sheeting elements to be extracted. The housing is constructed to be connected to the boom of an excavating machine or of a crane and can be set on the ground with there being a fluid cylinder mounted within the housing and acting in the longitudinal direction of the housing. The fluid cylinder including a piston rod carrying at least one movable guide pulley for a cable which is guided over at least one other guide pulley carried by the housing and which supports a hoisting traverse for acting on the sheeting element to be retracted.

In lieu of wooden sheeting costly in labor and material, increasing use is made of modern steel sheeting elements when sheeting trenches and channels, in particular service trenches, whether pile-sheeting with shaped trench sheets be used, or large-format self-supporting sheeting walls or plates which may be interconnected by guide braces and mutually transversely shored.

Although the setting up of sheeting elements is relatively simple and most of the time occurs by means of excavating buckets or pile driving mechanism, the extraction of the sheeting elements subsequent to the filling of the trenches in part requires very high tensile forces on the order of 20 to 50 metric tons.

Extraction of the sheeting elements generally takes place using traction means mounted to the boom of an excavator or a crane. However, the high tensile forces set forth above occur especially at construction depths of 3 to 8 meters and more and can just about be developed by the heaviest excavators and cranes. Unfortunately, such heavy equipment usually is not owned by construction enterprises which perform this type of work and would be too expensive if utilized solely for such extraction work.

A known extraction system disclosed in French Pat. No. 838,717 includes a tower-like housing forming at the same time an extensible cylinder. The reciprocating piston guide within the cylinder carries a double-boom frame similar to a balance-beam and is held by a ball joint and includes guide rollers at its free ends for an extraction cable passing over fixed guide rollers mounted to the housing base and ending in a hoisting traverse. Actuation of the piston lifts the double-boom frame and effects extraction of a sheeting element according to the hoisting stroke. This equipment requires re-tensioning of the extraction cable following each stroke and, therefore, requires excessive manual operation. Furthermore, it provides no force multiplication and, therefore, must be extremely heavy in design.

In U.S. Pat. No. 1,719,021 there is disclosed another extraction system suspended from a crane boom. It consists of a tower-like housing which can be set on floor sheeting and a block-and-tackle suspended from the housing. This system includes a movable piston acting on the floor sheeting to be pulled. The equipment amounts to a simple block-and-tackle and requires actuation by the crane. It is, therefore, relatively costly and unsuited for small sheeting extraction operations.

Modern economic sheeting extraction requires creating an extraction system of a simple design and of economical cost and operation even at small construction sites. Simultaneously, such an extraction system should allow easy set-up at the construction site, taking further into account that as a rule the soil near the trench is of lesser resistance than untouched terrain.

The solution to this problem is characterized in accordance with this invention in that an anchoring system on the one hand and fixed guide pulleys used for the extraction cables and projecting from the housing on the other hand are mounted on the upper end of the housing, in that the movable guide pulleys are guided inside the housing with the two extraction cables acting on one hand on the anchoring system and on the other hand on the fixed guide pulleys, and in that the movable and fixed guide pulleys form a block-and-tackle in association with the anchoring system.

Equipment formed in accordance with this invention can be set down at the site utilizing a conventional excavator which is present at the site in the normal course of operation, and may be held in such a manner that it operates satisfactorily even on less firm ground. This equipment, if necessary or desirable, may assume an oblique attitude whereby the excavator boom need only absorb tilting forces. Because of the hollow housing foot construction, a local compaction takes place underneath the housing and prevents excessive penetration of the housing into the ground.

Except for minor moments, the extracting forces are absorbed by the housing, whereby an extremely short force path is achieved.

The fluid cylinder permits hoisting actuation when appropriate or necessary even from a distance allowing clear observation of the extraction process.

The equipment of the invention can be easily moved. If appropriate, it may also be moved to a new site with the sheeting elements still suspended from it. Because it is simple in design, it does not unduly burden the sheeting or subsurface construction contractor.

In order to relieve the fluid cylinder load, and because deeply embedded sheeting elements provide only short extraction paths, the equipment in one of its embodiments provides at least a plurality of pulleys at the hoisting traverse to provide for a force multiplication block-and-tackle system.

In accordance with this invention, the extraction cables can be shortened after each lifting stroke.

Although the principles of the block-and-tackle system is not in and of itself new, it is believed that the system in connection with the fluid cylinder and the novel mounting of the housing is a positive advance in the art.

The system offers further advantageous characteristics in that a winding drum is supported in the housing as the anchorage for one of the ends of the extraction cable and is associated with a locking device opposing the rotation of the winding drum in the pay-out direction.

In a preferred embodiment of the invention, pairs of guide pulleys are mounted in the housing and on the hoisting traverse and interconnected by cables in block-and-tackle manner with extracting cables of which one is fastened to the housing and the other is guided around a movable guide pulley and fastened to a winding drum, there being means provided for alternating the locking extraction cable between the upper guide pulley and the movable pulley on the one hand and between the winding drum and the movable guide pulley on the other hand. This results in a further and significant force-relief of the fluid cylinder whereby the sheeting elements may be extracted using relatively low actuating forces.

SHORT DESCRIPTION OF THE FIGURES

Figure 1:
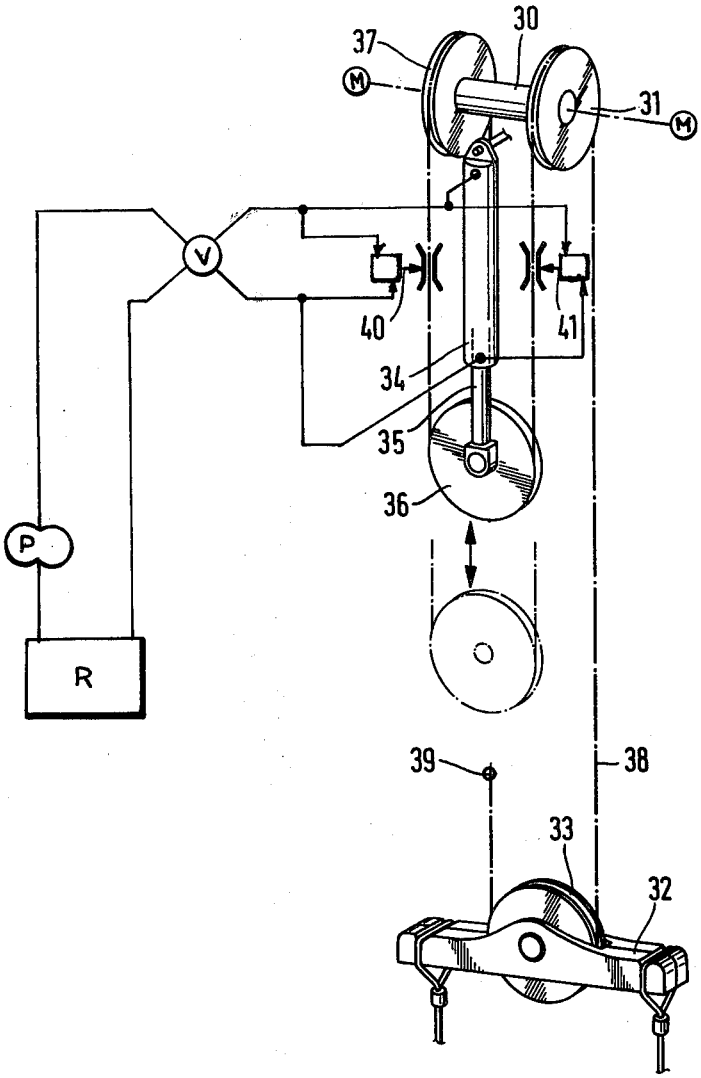
FIG. 1 is a schematic perspective view illustrating the features of the extraction system.

Referring first to the schematic illustration of FIG. 1, it will be seen that the extractor system includes a fixed upper guide pulley 31 mounted on a shaft 30. It is to be understood that the shaft 30 and the pulley 31 are to be mounted in a tower-like housing (not shown) as discussed with respect to a further embodiment of the invention. The system also includes a hoisting traverse 32 which is disposed outside of such housing and includes a guide pulley 33. The system further includes an extensible fluid cylinder 34 which is intended to have its upper end fixedly secured to the tower with the cylinder being within the tower and including a piston rod 35 supporting a movable guide pulley 36. The pulley 36 is movable between two remote positions through the extension of the piston rod 35. The shaft 30 also carries a winding drum 37.

One end of an extraction cable 38 is wound on the winding drum 37. The extraction cable 38 passes from the winding drum down around the pulley 36 and then up and over the upper guide pulley 31, then down and around the guide pulley 33 of the hoisting traverse 32. The cable 38 then extends upwardly from the pulley 33 and is fixedly anchored as at 39 at a suitable point on the housing.

Portions of the cable 38 between the movable pulley 36 and the winding drum 37 on the one hand and the upper guide pulley 31 and the pulley 36 are provided with locking systems 40, 41, respectively, which are actuatable to lock the cable 38 alternately at the forward and return strokes of the piston rod 35. It is to be understood that each of the locking systems 40, 41 is in the form of a hydraulically actuated clamp.

During operation, the removable guide pulley 36 is moved by the piston rod 35 to the lower point position which is shown in dashed lines. In the process of movement of the pulley 36, locking system 40 is locked and locking system 41 is released. The cable 38 being clamped against unreeling from the winding drum 37 is foreshortened with the result that the hoisting traverse 32 is lifted one step.

During the return stroke of piston rod 35, locking system 41 is closed and locking system 40 is opened. Winding drum 37, which is provided with drive means either in the form of a winding spring or motor, takes up the loose portion of the cable between the winding drum 37 and the locking system 41 with very little expenditure of force. Upon a new stroke of the cylinder 34, there is a reversal of the actuation of the locking systems 40, 41.

Figure 2:
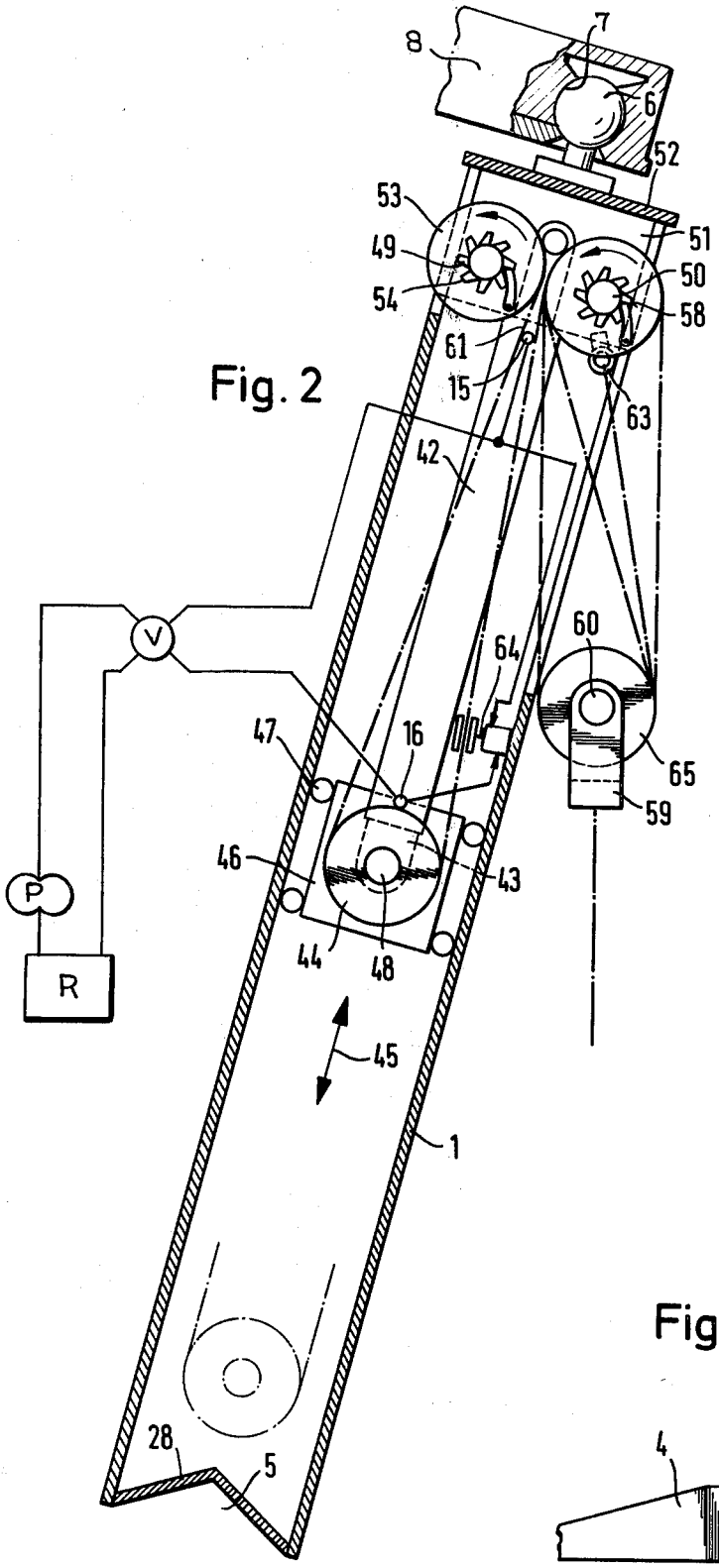
FIG. 2 is a side elevational view, with parts broken away and shown in section, of a more specific form of the extracting system.
Figure 3:
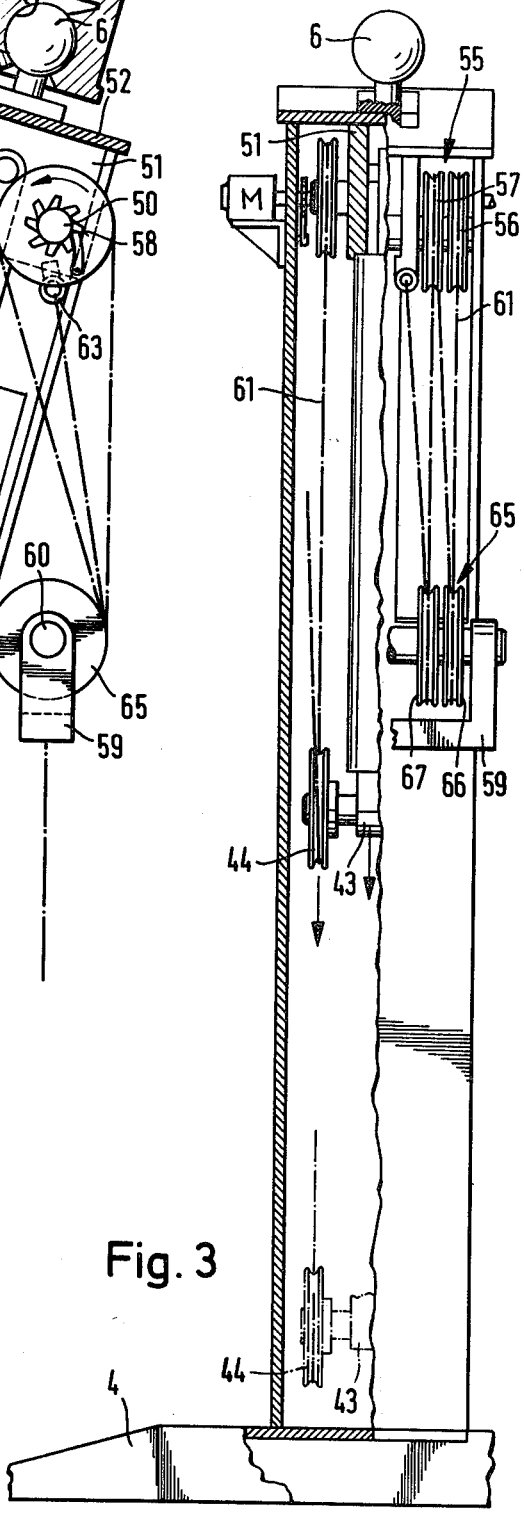
FIG. 3 is an end elevational view taken from the right of FIG. 2 with parts of the housing broken away and shown in section.

Reference is made to FIGS. 2 and 3 wherein a more specifically illustrated embodiment of the invention of FIG. 1 is illustrated. The extraction system of FIGS. 2 and 3 include a hollow tower-like housing 1 which may be readily formed from shaped sheet metal stock or shaped steel sections. The housing 1 includes an upper cover plate 52 which serves as a support for components of the system located within the housing 1. As will be described hereinafter, these components include guide rollers, a fluid cylinder and the like which are carried by a bearing block 51 which depends from the cover plate 52.

The housing 1 is closed at its bottom by housing foot 4 which extends transversely of the housing proper to opposite sides thereof. As is best shown in FIG. 2, the housing foot 4 is of an angular cross section so as to define a higher chamber 5 which opens downwardly. The housing foot 4 is primarily formed by an arched shaped plate 28 which due to its configuration causes a local compaction of the soil beneath the housing foot 4 when the housing 1 is supported on the ground and is in operation. It will be seen that the size and configuration of the housing foot 4 prevents the equipment from sinking excessively into the ground. It also permits the mounting of the housing 1 in its tilted or oblique position shown in FIG. 2.

In order that the housing 1 may be mounted in the oblique, tilting position of FIG. 2, the cover plate 52 carries a spherical ball or head 6 which is seated in a corresponding bearing 7 carried by a boom 8 of an excavator or similar device.

An extensible fluid cylinder 42 is supported along a plane or symmetry of the housing 1 from the bearing block 51 and includes a downwardly projecting piston rod 43. The piston rod 43 carries a pin or shaft 48 which has mounted on opposite ends thereof movable guide pulleys 44. The pulley 44 may be moved in the direction shown by the arrow 45 in FIG. 2 between a top dead position shown in solid lines and a bottom dead position shown in dash-dot lines. In order that the lower end of the piston rod 43 may be suitably guided with respect to the housing 1, the pin 48 may carry a guide thread 46 provided with rollers 47 which engage the inside wall of the housing 1.

The bearing block 51 mounts in the upper part of the housing 1 a pair of shafts 49, 50 which are disposed in parallel relation to one another and to the pin 48. Two independently rotating winding drums 53, each equiped with a clutch-type free wheel mechanism 54 are carried by the shaft 49. The free wheel mechanism 54 for each of the winding drums 53 is effective in the take-up direction unless engaged (pay-out of cables associated therewith as will be described hereinafter).

The shaft 50 also carries two groups, generally identified by the numeral 55, of guide pulleys. Each group 55 of guide pulleys preferably includes two pulleys 55, 56, although one pulley could suffice. One of the guide pulleys, pulley 56, is equiped with a free wheel mechanism 58 acting in the direction of take-up of the winding drums 53.

The mechanism also includes a hoisting traverse 59 mounted outside of the housing 1. The hoisting traverse 59 carries a shaft 60 on which there are mounted two groups, generally designated by the numeral 65, of guide pulleys. It is to be understood that the number of guide pulleys in each group 65 corresponds to the number of guide pulleys in each group 55. Accordingly, each group of guide pulleys 65 is illustrated as including two guide pulleys 66, 67.

The system also includes two extracting cables 61, each of which has a terminal end fastened to a respective one of the winding drums 53. It is to be understood that each winding drum will be conventionally equiped with a winding mechanism of the spring or motor type (not specifically shown).

Each of the cables 65 passes down and around one of the two movable guide pulleys 44 and then to a respective one of the upper guide pulleys 56. Each cable 61 passes from the associated guide pulley 56 down to a respective guide pulley 66 of the hoisting traverse 59 and then up and around the respective guide pulleys 57. Each cable then passes down around the respective guide pulleys 67 and up once again to an anchoring ring 63 on the housing 1.

It is to be understood that each cable 61 is provided with a clamping system 64 between respective movable pulley 44 and the respective upper guide pulley 56. It is to be understood that the clamping system 64 is so actuated that it blocks extraction of the respective cable 61 during the upward stroke of the fluid cylinder 42.

The groups 55, 65 of guide pulleys, together with appropriate portions of the cables 61, form a block-and-tackle system of a conventional type and may include an arbitrary number of guide rollers, depending upon the force multiplication factor desired. It is to be understood that the block-and-tackle system permits relatively high traction forces utilizing a relatively small capacity fluid cylinder 42.

When the movable guide pulleys 44 are moved downwardly by the extension of the fluid cylinder 42, the hoisting traverse 59 is raised a certain amount depending upon the multiplication factor of the block-and-tackle system. On the return stroke of the cylinder 42, the locking systems 64 stop the traction cables 61 and allow rotation of the winding drums 53 in the direction of the arrow thereon in FIG. 2. Winding drums 53 are locked by the free wheel 54 during the extension stroke of the cylinder 42 with the locking system 64 being open.

The symetric arrangement of the traction units inside of the housing 1 prevent additional cross forces and inaccuracies in guidance.

Most specifically with respect to the embodiment of FIGS. 2 and 3, it is to be understood that the hydraulic system of the piece of excavating equipment of which the boom 8 is a part may be utilized for the operation of the retraction system. It is first of all particularly pointed out here that the cylinder 42 is a double acting cylinder and has fluid connections 15, 16. In accordance with this invention, the pump P and reservoir R of the piece of excavating equipment has coupled thereto a conventional rotary valve V which selectively connects the pump P and the reservoir R to the fittings 15, 16. In addition, it is to be seen that the clamping system 64 includes a small double acting hydraulic cylinder which is so interconnected with the extensible cylinder 42 so that the opening and closing of the clamping system 64 is automatically effected in accordance with the aforedescribed operation description.

Reference is now made to FIG. 1 wherein the hydraulic cylinder 34 and the hydraulic cylinders of the clamping systems 40, 41 are also illustrated as being connected to the hydraulic system of the excavating equipment with which the device is associated by way of a valve V.

It is to be understood that the system allows fully automatic extraction operation without any manual adjustment of the suspension of the extracting mechanism. The equipment will be generally of the same height or higher than the sheeting elements to be extracted and may be moved without any difficulties to the construction site and, furthermore, may be also stored there in a convenient manner.

I claim:

1. Apparatus for extracting sheeting walls, sheeting plates, piles or like sheeting elements used in trench sheeting comprising a tower-like housing having a lower end portion adapted to be set on the ground and an upper end portion to be pivotally connected to a boom of a crane or the like, said housing being of approximately the height of an element adapted to be extracted thereby, longitudinally acting extensible fluid cylinder-piston means within said housing and being defined by a cylinder and a piston rod, one of said cylinder and piston rod carrying a first movable guide pulley and the other of said cylinder and piston rod being connected to said housing, a second guide pulley projecting from one side of said housing at said upper end portion and being fixed thereat, traction means including a cable entrained about said pulleys and about a third pulley exteriorly of said housing connected to a hoisting traverse, means for anchoring one end of said cable at said upper end portion, means for guiding the movement of said first pulley within said housing along a generally linear path of travel along the length of said housing, and said first through third pulleys and said cable means define a block and tackle system.

2. The apparatus of claim 1 wherein said means anchoring one end of said cable includes a winding drum receiving said cable one end and a locking mechanism for presenting cable pay-out from said winding drum.

3. The apparatus of claim 2 wherein said locking mechanism is in the form of a one-way clutch-brake coupled to said winding drum.

4. The apparatus of claim 3 wherein said one-way clutch-brake is of the ratchet and pawl type.

5. The apparatus of claim 2 wherein said locking mechanism is in the form of a releasable cable clamp disposed between said winding drum and said movable guide pulley.

6. The apparatus of claim 2 together with a second locking mechanism for locking said cable in a withdrawn position.

7. The apparatus of claim 6 wherein said second locking mechanism includes a one-way clutch-brake for said fixed guide pulley.

8. The apparatus of claim 6 wherein said second locking mechanism is in the form of a releasable cable clamp disposed between said movable guide pulley and said fixed guide pulley.

9. The apparatus of claim 6 wherein said second locking mechanism includes a one-way clutch-brake for said fixed guide pulley, and a releasable cable clamp disposed between said movable guide pulley and said fixed guide pulley.

10. The apparatus of claim 1 wherein there are pairs of said anchoring means, said fixed guide pulley, said movable guide pulley and said cable, and said pair of said movable guide pulleys are carried by said fluid cylinder for simultaneously withdrawing both of said cables.

11. The apparatus of claim 10 wherein there are pairs of plural guide cylinders carried by said hoisting traverse and plural ones of said fixed guide pulleys for each of said cables, and said cables are entrained over said plural guide pulleys to form plural block-and-tackle systems.

12. The apparatus of claim 1 wherein said housing lower end portion has an elongated foot defining a downwardly opening hollow chamber.

13. The apparatus of claim 12 wherein said housing foot includes an arched cover plate.

14. The apparatus of claim 1 wherein said housing includes a spherical head at its upper end portion for joining said housing in supported relation to a boom of a crane or the like.

15. The apparatus of claim 1 wherein said housing includes a cover plate and said fixed guide pulley, said fluid cylinder and said anchoring means are all suspended from said cover plate.

* * * * *